US007467434B1

(12) United States Patent
Kunde et al.

(10) Patent No.: US 7,467,434 B1
(45) Date of Patent: Dec. 23, 2008

(54) BED FRAME ATTACHABLE TRANSFER BAR DEVICE

(76) Inventors: Michael F. Kunde, 1261 Shoal Ridge Rd., Oconomowoc, WI (US) 53066; Marie H. Kunde, 1261 Shoal Ridge Rd., Oconomowoc, WI (US) 53066

( * ) Notice: Subject to any disclaimer, the term of this patent is extended or adjusted under 35 U.S.C. 154(b) by 149 days.

(21) Appl. No.: 11/702,921

(22) Filed: Feb. 6, 2007

Related U.S. Application Data

(60) Provisional application No. 60/772,714, filed on Feb. 13, 2006.

(51) Int. Cl.
*A47C 21/00* (2006.01)
*A47C 21/08* (2006.01)

(52) U.S. Cl. ..... 5/662; 5/424; 5/428

(58) Field of Classification Search ..... 5/424, 5/428, 662, 429, 430
See application file for complete search history.

(56) References Cited

U.S. PATENT DOCUMENTS 3,021,534 A 2/1962 Hausted ..... 5/331
3,863,282 A * 2/1975 Stillwell ..... 5/503.1
5,384,927 A * 1/1995 Mardero et al. ..... 5/662
6,012,182 A * 1/2000 Allen et al. ..... 5/81.1 R
6,728,985 B2 5/2004 Brook et al. ..... 5/662
6,986,177 B2 * 1/2006 Thaxton ..... 5/81.1 R

* cited by examiner

*Primary Examiner*—Michael Trettel
(74) *Attorney, Agent, or Firm*—Donald J. Ersler

(57) ABSTRACT

A bed frame attachable transfer bar device preferably includes a rail attachment member, a turnbuckle, a second rail attachment member and a transfer bar. The rail attachment member includes a first lengthwise member and a first rail engagement member attached to one end of the first lengthwise member. The second rail attachment member includes a second lengthwise member, a second rail engagement member and a transfer bar receiver. The second rail engagement member is attached to one end of the second lengthwise member. The transfer bar receiver is attached to the second rail engagement member and the second lengthwise member. The rail attachment member is attached to the second rail attachment member with the turnbuckle. The transfer bar preferably includes a hand ring and a support post extending downward from the hand ring. The support post is sized to be received by the transfer bar receiver.

20 Claims, 3 Drawing Sheets

BED FRAME ATTACHABLE TRANSFER BAR DEVICE

CROSS-REFERENCES TO RELATED APPLICATIONS

This is a utility patent application taking priority from provisional application No. 60/772,714 filed on Feb. 13, 2006.

BACKGROUND OF THE INVENTION

1. Field of the Invention

The present invention relates generally to providing assistance for getting in and out of a bed, and more specifically to a bed frame attachable transfer bar device, which greatly reduces the risk of injury or death from entrapment.

2. Discussion of the Prior Art

There are numerous transfer bars in the art that aid in getting infirm, disabled and elderly people in and out of bed. A poorly designed transfer device can result in the injury and death to people trying to get out of a bed. U.S. Pat. No. 3,021,534 to Hausted discloses adjustable bed rails. The Hausted patent includes a pair of fences that are adjustable attached to frame rails of a bed. U.S. Pat. No. 6,728,985 to Brooke et al. discloses an ambulatory assist arm apparatus. The Brooke et al. patent includes an ambulatory assist arm apparatus for use with a patient support having a support surface and a frame, which includes a mounting bracket and body.

Accordingly, there is a clearly felt need in the art for a bed frame attachable transfer bar device, which is attachable to most bed frames and greatly reduces the risk of injury or death from entrapment, when trying to get out of a bed.

SUMMARY OF THE INVENTION

The present invention provides a bed frame attachable transfer bar device, which is attachable to most bed frames. The bed frame attachable transfer bar device (transfer bar device) preferably includes a rail attachment member, a turnbuckle, a second rail attachment member and a transfer bar. The rail attachment member includes a first lengthwise member and a first rail engagement member attached to one end of the first lengthwise member. The second rail attachment member includes a second lengthwise member, a second rail engagement member and a transfer bar receiver. The second rail engagement member is attached to one end of the second lengthwise member. The transfer bar receiver is attached to the second rail engagement member and the second lengthwise member. The first and second rail engagement members are sized to receive an outer perimeter of most bed frame rails. The rail attachment member is attached to the second rail attachment member with the turnbuckle. A first fastener is secured to the other end of the rail attachment member and one end of the turnbuckle. A second fastener is secured to the other end of the second rail attachment member and the other end of the turnbuckle.

The transfer bar preferably includes a hand ring and a support post extending downward from the hand ring. The support post is sized to be received by the transfer bar receiver. At least one spring pin extends from the support post. A retention hole and an exit hole are formed through the transfer bar receiver to receive the at least one spring pin. The retention hole orients the hand ring, such that the hand ring is parallel with a side of the bed. The exit hole orients the hand ring, such that the hand ring is substantially perpendicular to the side of the bed. A second transfer bar receiver may be attached to the rail attachment member to retain a second transfer bar.

Accordingly, it is an object of the present invention to provide a transfer bar device, which is attachable to most bed frames.

Finally, it is another object of the present invention to provide a transfer bar device, which greatly reduces the risk of injury or death from entrapment.

These and additional objects, advantages, features and benefits of the present invention will become apparent from the following specification.

DETAILED DESCRIPTION OF THE PREFERRED EMBODIMENTS

Figure 1:
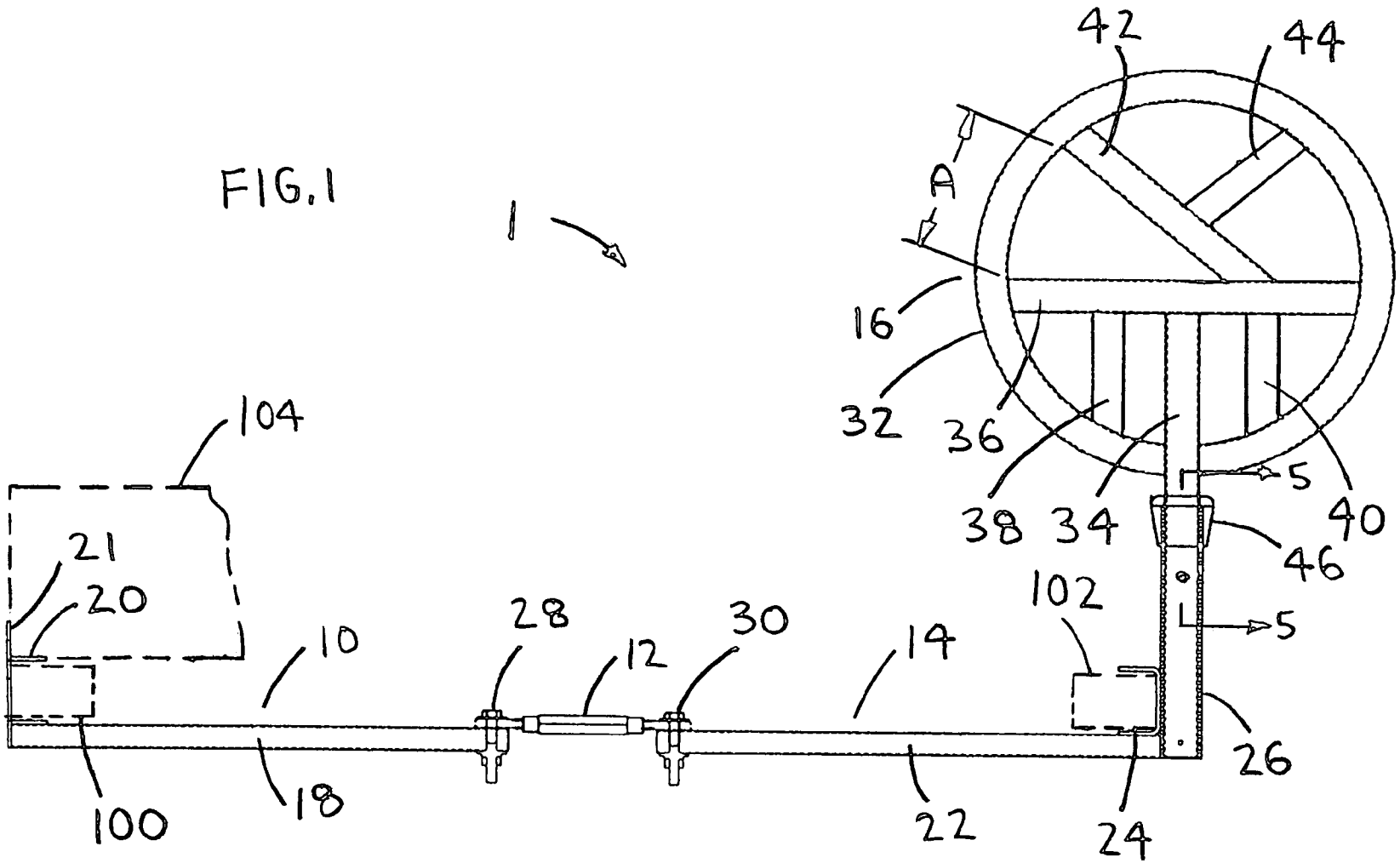
FIG. 1 is an end view of a transfer bar device retained on a bed frame with a hand ring in an exit position in accordance with the present invention.
Figure 2:
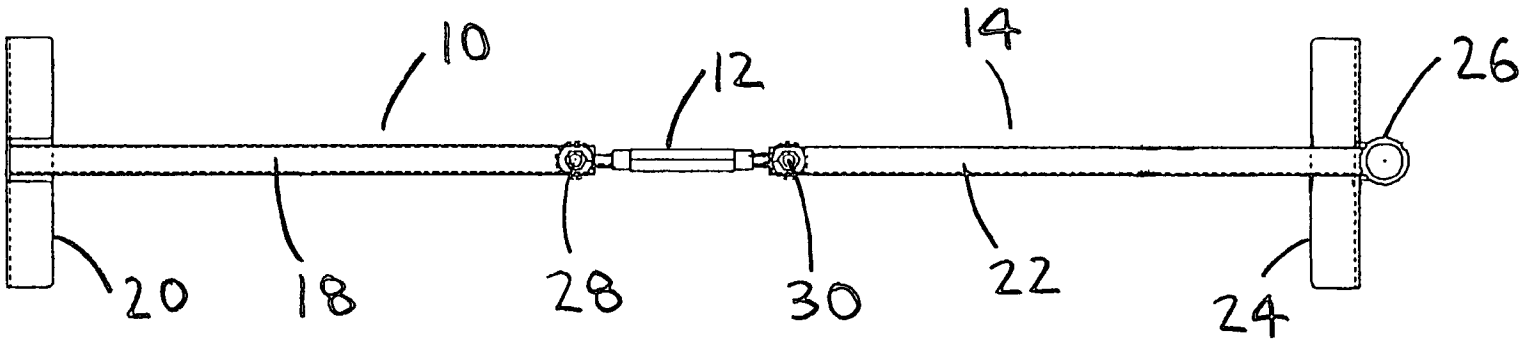
FIG. 2 is a top view of a transfer bar device with a transfer bar removed in accordance with the present invention.
Figure 3:
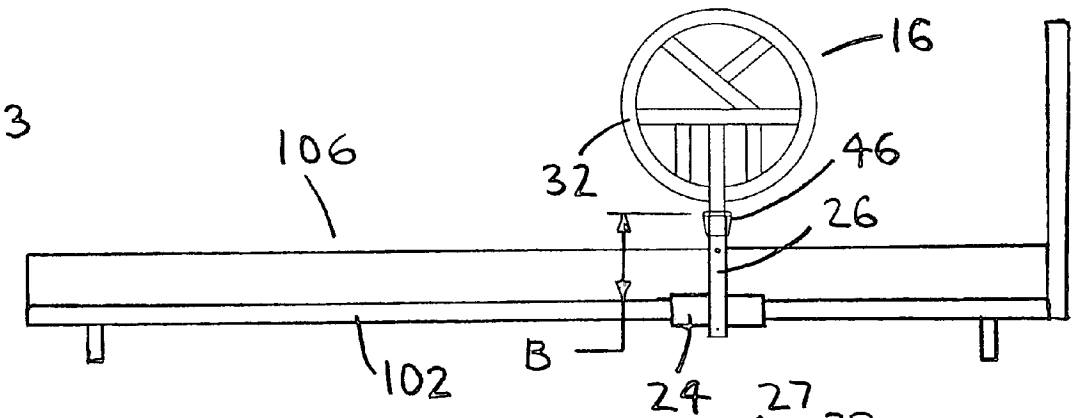
FIG. 3 is a side view of a transfer bar device attached to a bed frame in accordance with the present invention.
Figure 4:
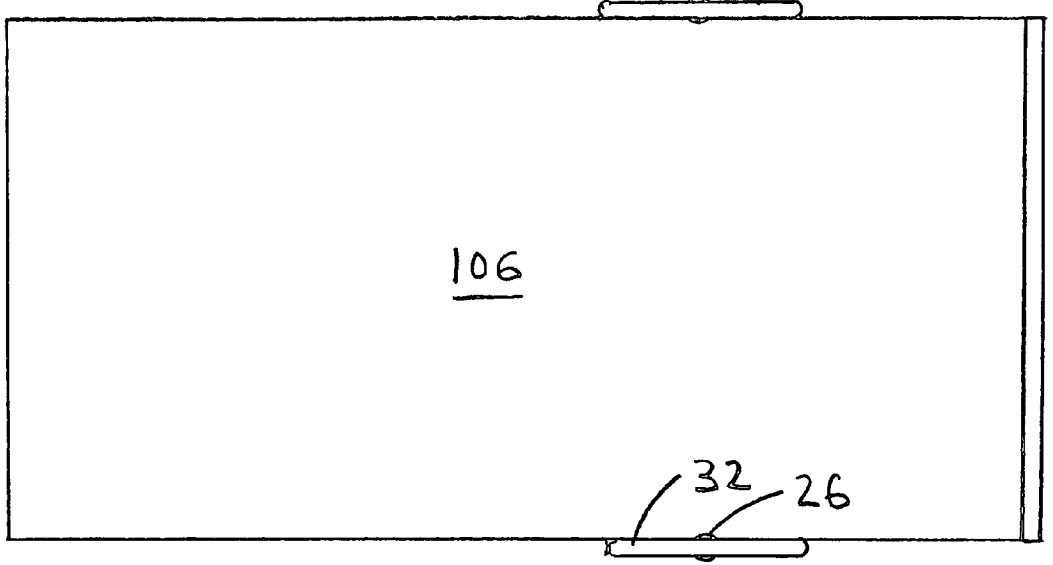
FIG. 4 is a top view of a transfer bar device attached to a bed frame with two transfer bars in accordance with the present invention.

With reference now to the drawings, and particularly to FIG. 1, there is shown an end view of a transfer bar device 1. With reference to FIGS. 2-4, the transfer bar device 1 preferably includes a rail attachment member 10, a turnbuckle 12, a second rail attachment member 14 and a transfer bar 16. The rail attachment member 10 includes a first lengthwise member 18 and a first rail engagement member 20. The first rail engagement member 20 is attached to one end of the first lengthwise member 18. The first rail engagement member 20 includes a U-shaped cross-section that is sized to receive an outer perimeter of a bed frame rail 100. A mattress stay 21 preferably extends from a top of the first rail engagement member 20. The mattress stay 21 prevents a mattress 104 from sliding relative to the first rail engagement member 20. The second rail attachment member 14 includes a second lengthwise member 22, a second rail engagement member 24 and a transfer bar receiver 26. The second rail engagement member 24 is attached to one end of the second lengthwise member 22. The second rail engagement member 24 includes a U-shaped cross-section that is sized to receive an outer perimeter of a bed frame rail 102.

The transfer bar receiver 26 is attached to the second rail engagement member 24 and the second lengthwise member 22. The first and second rail engagement members are sized to receive an outer perimeter of most bed frame rails. The rail attachment member 10 is attached to the second rail attachment member 14 with the turnbuckle 12. The turnbuckle 12 allows the distance between the inside of the first and second rail engagement members to be adjusted. A first fastener 28 is secured to the other end of the rail attachment member 10 and one end of the turnbuckle 12. A second fastener 30 is secured to the other end of the second rail attachment member 14 and the other end of the turnbuckle 12. However, other length adjustments devices besides the turnbuckle 12 may also be used.

The transfer bar 16 preferably includes a hand ring 32 and a support post 34. The support post 34 extends downward from the hand ring 32. The hand ring 32 is shown as having a substantially round shape, but could have any appropriate shape, such as an oval shape. A cross-tube 36 is preferably fastened in substantially a middle of the hand ring 32 to help support the hand ring 32. A first safety tube 38 and a second safety tube 40 are attached between the cross-tube 36 and an inner perimeter of the hand ring 32. The first and second safety tubes prevent chin entrapment. A first grasping tube 42 is attached between the cross bar 36 and an inside perimeter of the hand ring 32. A second grasping tube 44 is preferably attached between the cross bar 36 and the inside perimeter of the hand ring 32. The largest gap contained in the inner perimeter of the hand ring 32 cannot exceed a dimension "A" of 4¾ inches, according to federal regulations.

Figure 5:
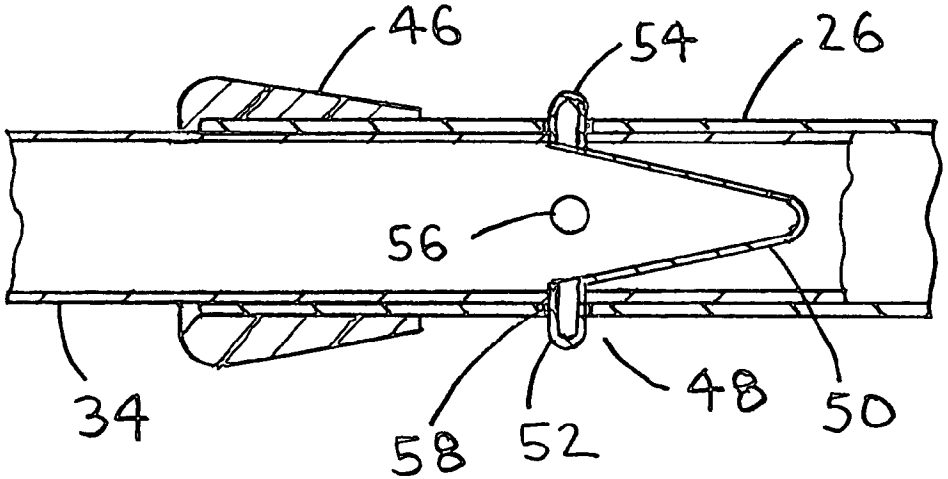
FIG. 5 is a cross-sectional view of a support post retained inside a transfer bar receiver illustrating a pair of spring pins of a transfer bar device in accordance with the present invention.

The support post 34 is sized to be received by an inner perimeter of the transfer bar receiver 26. With reference to FIG. 5, a protective boot 46 is preferably slipped over an end of the transfer bar receiver 26 for safety purposes. The dimension "B" from a top of the rail engagement members 20, 24 to a top of the protective boot 46 is preferably 5¼ inches. A spring pin insert 48 preferably includes a spring loaded body 50, a first spring pin 52 and a second spring pin 54. The spring loaded body 50 is biased, such that force must be applied to push the first and second spring pins against each other. A retention hole 56 and an exit hole 58 are formed through the transfer bar receiver 26 to receive the first and second spring pins. One design of spring pin insert 48 is shown, but other designs may also be used. The retention hole 56 orients the hand ring 32, such that the hand ring 32 is parallel with a side of the bed 106. The exit hole 58 orients the hand ring 32, such that the hand ring 32 is substantially perpendicular to the side of the bed 106. A second transfer bar receiver 27 may be attached to the rail attachment member 10 to retain a second transfer bar 33.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A bed frame attachable transfer bar device, comprising:

a first rail attachment member receiving a first bed frame rail;

a second rail attachment member receiving a second bed frame rail;

means for adjusting a length between the other ends of said first and second rail attachment members;

a transfer bar having a support post extending therefrom;

a transfer bar receiver being formed on one end of at least one of said first and second attachment members, said transfer bar receiver being sized to receive said support post; and at least one spring pin extending from said support post, a retention hole and an exit hole being formed through said transfer bar receiver, said retention hole being substantially perpendicular to said exit hole.

2. The bed frame attachable transfer bar device of claim 1, wherein:

said means for adjusting a length being a turnbuckle.

3. The bed frame attachable transfer bar device of claim 1, further comprising:

said transfer bar including a hand ring, a cross tube and a support post, said cross tube being attached to substantially a middle of said hand ring, said support post being attached to said hand ring and said cross tube.

4. The bed frame attachable transfer bar device of claim 3, wherein:

said hand ring having a substantially round shape.

5. The bed frame attachable transfer bar device of claim 3, further comprising:

at least one safety tube being attached to said cross tube and said hand ring, at least one grasping tube being attached to said hand ring.

6. The bed frame attachable transfer bar device of claim 1, wherein:

said first and second rail engagement member having a U-shaped cross-section to receive an outer perimeter of a bed frame rail.

7. The bed frame attachable transfer bar device of claim 1, further comprising:

a second transfer bar having a second support post extending therefrom, a second transfer bar receiver being formed on one of said second rail attachment member and said first rail attachment member, said second transfer bar receiver being sized to receive said second support post.

8. A bed frame attachable transfer bar device, comprising:

a first rail attachment member receiving a first bed frame rail;

a second rail attachment member receiving a second bed frame rail;

means for adjusting a length between the other ends of said first and second rail attachment members;

a transfer bar having a hand ring, a cross tube and a support post, said cross tube being attached to substantially a middle of said hand ring, said support post being attached to said hand ring and said cross tube; and a transfer bar receiver being formed on one end of at least one of said first and second attachment members, said transfer bar receiver being sized to receive said support post.

9. The bed frame attachable transfer bar device of claim 8, further comprising:

at least one spring pin extending from said support post, a retention hole and an exit hole being formed through said transfer bar receiver, said retention hole being substantially perpendicular to said exit hole.

10. The bed frame attachable transfer bar device of claim 8, wherein:

said means for adjusting a length being a turnbuckle.

11. The bed frame attachable transfer bar device of claim 8, further comprising:

said hand ring having a substantially round shape.

12. The bed frame attachable transfer bar device of claim 8, further comprising:

at least one safety tube being attached to said cross tube and said hand ring, at least one grasping tube being attached to said hand ring.

13. The bed frame attachable transfer bar device of claim 8, wherein:

said first and second rail engagement member having a U-shaped cross-section to receive an outer perimeter of a bed frame rail.

14. A bed frame attachable transfer bar device, comprising:

a first rail attachment member receiving a first bed frame rail;

a second rail attachment member receiving a second bed frame rail;

means for adjusting a length between the other ends of said first and second rail attachment members;

a transfer bar having a support post extending therefrom; and a transfer bar receiver being formed on one end of at least one of said first and second attachment members, said transfer bar receiver being sized to receive said support post; and a second transfer bar having a second support post extending therefrom, a second transfer bar receiver being formed on one of said second rail attachment member and said first rail attachment member, said second transfer bar receiver being sized to receive said second support post.

15. The bed frame attachable transfer bar device of claim 14, further comprising:

at least one spring pin extending from said support post, a retention hole and an exit hole being formed through said transfer bar receiver, said retention hole being substantially perpendicular to said exit hole.

16. The bed frame attachable transfer bar device of claim 14, wherein:

said means for adjusting a length being a turnbuckle.

17. The bed frame attachable transfer bar device of claim 14, further comprising:

said transfer bar including a hand ring, a cross tube and a support post, said cross tube being attached to substantially a middle of said hand ring, said support post being attached to said hand ring and said cross tube.

18. The bed frame attachable transfer bar device of claim 17, wherein:

said hand ring having a substantially round shape.

19. The bed frame attachable transfer bar device of claim 17, further comprising:

at least one safety tube being attached to said cross tube and said hand ring, at least one grasping tube being attached to said hand ring.

20. The bed frame attachable transfer bar device of claim 14, wherein:

said first and second rail engagement member having a U-shaped cross-section to receive an outer perimeter of a bed frame rail.

* * * * *